US007946277B2

(12) United States Patent
Essig

(10) Patent No.: US 7,946,277 B2
(45) Date of Patent: May 24, 2011

(54) FUEL VAPOR STORAGE AND RECOVERY SYSTEM

(75) Inventor: Ulrich Essig, Wendlingen (DE)

(73) Assignee: Dr. Ing. h.c. F. Porsche AG, Stuttgart (DE)

( * ) Notice: Subject to any disclaimer, the term of this patent is extended or adjusted under 35 U.S.C. 154(b) by 87 days.

(21) Appl. No.: 12/435,433

(22) Filed: May 5, 2009

(65) Prior Publication Data

US 2009/0308358 A1 Dec. 17, 2009

(30) Foreign Application Priority Data

Jun. 11, 2008 (DE) ..... 10 2008 027 871

(51) Int. Cl.
*F02M 37/20* (2006.01)
*F02M 15/00* (2006.01)

(52) U.S. Cl. ..... 123/516; 123/518; 123/540

(58) Field of Classification Search ..... 123/516, 123/518, 519, 520, 540–542, 573
See application file for complete search history.

(56) References Cited

U.S. PATENT DOCUMENTS

| | | | | |
|---|---|---|---|---|
| 4,159,698 | A * | 7/1979 | Berenbaum | 123/41.31 |
| 4,671,071 | A * | 6/1987 | Sasaki | 62/47.1 |
| 4,732,588 | A * | 3/1988 | Covert et al. | 96/144 |
| 4,829,968 | A * | 5/1989 | Onufer | 123/518 |
| 4,846,135 | A * | 7/1989 | Tiphaine | 123/520 |
| 4,919,103 | A * | 4/1990 | Ishiguro et al. | 123/514 |
| 5,021,071 | A * | 6/1991 | Reddy | 95/106 |
| 5,255,735 | A * | 10/1993 | Raghava et al. | 165/111 |
| 5,377,644 | A | 1/1995 | Krohm | |
| 5,415,196 | A * | 5/1995 | Bryant et al. | 137/14 |
| 5,740,784 | A * | 4/1998 | McKinney | 123/509 |
| 5,957,113 | A * | 9/1999 | Masaki et al. | 123/518 |
| 5,964,204 | A * | 10/1999 | Freeland | 123/516 |
| 6,098,601 | A * | 8/2000 | Reddy | 123/520 |
| 6,230,692 | B1 * | 5/2001 | Thompson | 123/516 |
| 6,569,228 | B2 * | 5/2003 | Ito | 96/134 |
| 7,114,492 | B2 * | 10/2006 | Reddy | 123/518 |
| 7,380,543 | B2 * | 6/2008 | Hatano et al. | 123/519 |
| 7,444,996 | B2 * | 11/2008 | Potier | 123/519 |
| 7,527,045 | B2 * | 5/2009 | Chung | 123/519 |
| 2009/0194076 | A1 * | 8/2009 | Elwart et al. | 123/519 |

FOREIGN PATENT DOCUMENTS

| | | | |
|---|---|---|---|
| DE | 4140090 | A1 | 6/1993 |
| DE | 4316728 | A1 | 3/1994 |
| DE | 19544461 | A1 | 6/1996 |
| DE | 112005001728 | T5 | 6/2007 |

* cited by examiner

*Primary Examiner* — Thomas N Moulis

(57) ABSTRACT

A fuel vapor storage and recovery system of an internal combustion engine includes a fuel tank and a filter device arranged in a tank venting line. A heat exchanger is disposed in the tank venting line. The heat exchanger cools the fuel vapors flowing from the fuel tank to the filter device and heats air that is aspirated for scavenging the filter device.

6 Claims, 1 Drawing Sheet

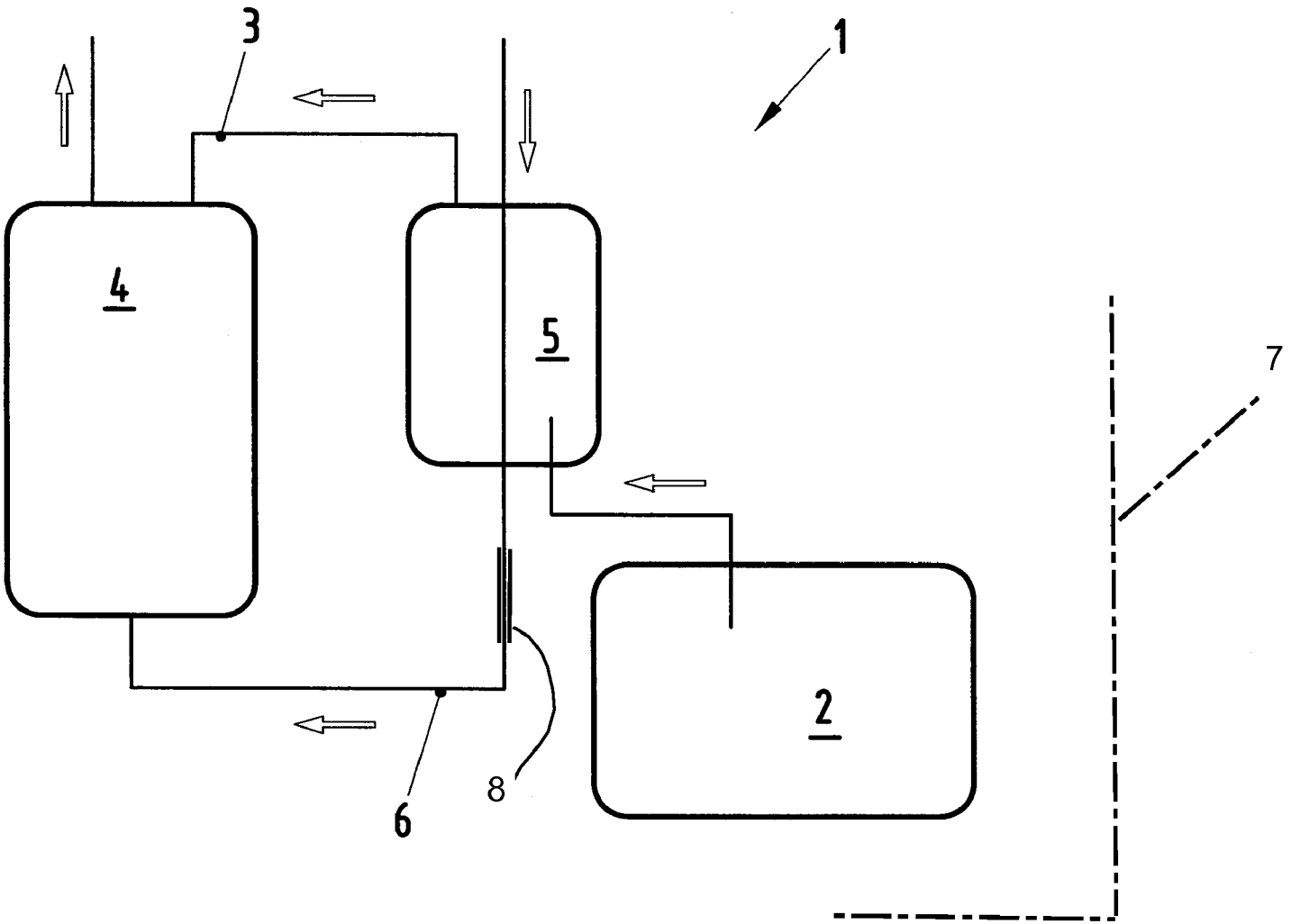
1
2
3
4
5
6
7
8

FUEL VAPOR STORAGE AND RECOVERY SYSTEM

CROSS-REFERENCE TO RELATED APPLICATION

This application claims the priority, under 35 U.S.C. §119, of German paten application DE 10 2008 027 871.8, filed Jun. 11, 2008; the prior application is herewith incorporated by reference in its entirety.

BACKGROUND OF THE INVENTION

Field of the Invention

The present invention relates to a fuel vapor accumulator/recovery system for an internal combustion engine, with a fuel tank and with a filter device arranged in a tank venting line The invention relates, moreover, to a motor vehicle equipped with a fuel vapor accumulator/recovery system of the type.

U.S. Pat. No. 7,444,996 B2 (cf. EP 20040103507) discloses a generic fuel vapor storage and recovery system which has a vapor accumulator canister with a material absorbing fuel vapor and also a heat insulation device for the heat insulation of at least part of the fuel tank against the heat generated by an exhaust pipe. Furthermore, a heat exchanger is provided, which is adapted such that air routed through it can be heated to a scavenging or discharge temperature by the absorption of heat from the heat insulation device. As a result, in particular, the backwash action for cleaning the activated charcoal filter is to be improved.

German published patent application DE 41 40 090 A1 describes a motor vehicle with a filter device arranged in a tank venting line, the filter device being arranged between the fuel tank and an adjacent portion of an exhaust system, in order, on the one hand, to protect the fuel tank against radiant heat from the exhaust system and, on the other hand, to achieve a heating of the filter device and, consequently, a more rapid regeneration of the activated charcoal contained in it.

A method and an apparatus for the filtering of tank gases are known from German published patent application DE 195 44 461. In a method for emptying a liquid container into a tank, in this case a vacuum is generated in the tank by means of a vacuum pump in order thereby to fill the tank. The pollutant-containing gas mixture escaping from the tank is at least partially solidified in a cooled tank gas filter, while the remaining part of the gas mixture is dried, reheated and purified by means of an activated charcoal filter. The solidified part heats up again after the filling operation and is intercepted in liquid form in a condensate collecting container.

Finally, an apparatus for the directed collection and for the metering of volatile fuel components in an internal combustion engine is described in German published patent application DE 43 16 728 A1. The apparatus has a collecting container for the volatile fuel components, a regeneratable accumulator and a duct for connecting the accumulator in the suction duct of the internal combustion engine, and a metering valve in the respective connecting duct. The metering valve is in this case actuated via a control unit according to the admixing of the volatile fuel components which is desired in the respective operating state, with the result that an optimization of the operation of the engine is to be achieved.

SUMMARY OF THE INVENTION

It is accordingly an object of the invention to provide a fuel vapor storage and recovery system, which overcomes the above-mentioned disadvantages of the heretofore-known devices and methods of this general type and which provides for an improved fuel vapor accumulator/recovery system which has, on the one hand, a high recovery rate and, on the other hand, an improved accumulator function.

With the foregoing and other objects in view there is provided, in accordance with the invention, a fuel vapor storage and recovery system of an internal combustion engine, comprising:

a fuel tank, a tank venting line communicating with said fuel tank and conducting fuel vapors from said fuel tank, and a filter device disposed in said tank venting line; and a heat exchanger disposed in said tank venting line, configured to cool the fuel vapors flowing from said fuel tank to said filter device and to heat ambient air aspirated in for scavenging said filter device.

In other words, the invention is based on the general concept of arranging, in a tank venting line of a fuel vapor accumulator/recovery system of an internal combustion engine, a heat exchanger which, on the one hand, cools the fuel vapors flowing from the fuel tank to a filter device and, on the other hand, heats the ambient air sucked in for scavenging the filter device. The filter device is in this case arranged in the tank venting line of the fuel tank, both the intake line which communicates with the environment and the line leading from the fuel tank to the filter device being routed through the heat exchanger according to the invention, so that, by means of the latter, several surprisingly positive effects can be achieved. On the one hand, for example, the fuel vapors escaping from the fuel tank can be cooled and, most advantageously, liquefied, so that these do not even arrive at the filter device at all, but flow from the heat exchanger back to the fuel tank still in the liquefied state. This effect is to be observed, in particular, after the cooling of the fuel tank, that is to say after the stopping of the motor vehicle. On the other hand, what can be achieved thereby is that the ambient air sucked in for scavenging the filter device is heated by the heat exchanger and the scavenging performance is thereby improved, while the air quantity remains the same. Owing to the improved scavenging performance and to the liquefaction of the fuel vapors as early as in the heat exchanger, the filter device can be designed to be smaller overall, since, on the one hand, fewer fuel vapors reach the filter device and, on the other hand, the backwash and therefore a degree of regeneration are markedly improved.

In accordance with an advantageous feature of the invention, the filter device has activated charcoal. Activated charcoal is an extremely fine-grained coal with a very large internal surface, which, because of this large internal surface, is already in widespread use as an adsorbent in filter devices, in particular for hydrocarbons. Activated charcoal in this case consists predominantly of carbon having a highly porous structure, the pores of the activated charcoal being connected to one another in the same way as in a sponge. The internal surface in this case amounts to between 300 and 2000 $m^2/g$ of activated charcoal, and it is on this that its high adsorbent capacity is based. In general, in addition to the hydrocarbons, further pollutants can also be bound by means of activated charcoal, and therefore a particularly high filtering action can be achieved, using activated charcoal in a filter device.

The heat exchanger is expediently arranged above the fuel tank, so that fuel vapor liquefied by it can flow back into the fuel tank solely as a result of gravity. By virtue of the chosen arrangement, the fuel liquefied in the heat exchanger, can, in particular after the motor vehicle has stopped, flow back into the fuel tank without further aids, that is to say solely as a result of gravity, and therefore a particularly high recovery rate can be achieved. Further recirculation devices are not necessary for this purpose.

In accordance with an added feature of the invention, at least one line leading from the heat exchanger to the filter device is heat-insulated. What can be achieved thereby is that the ambient air sucked in from the surroundings and heated in the heat exchanger maintains a temperature necessary for an optimal scavenging action, even after it leaves the heat exchanger and until it reaches the filter device. This is highly advantageous, particularly at very low ambient temperatures, since, in this case, the ambient air heated only slightly in the heat exchanger would be cooled again in the case of a long connecting line to the filter device and consequently lose its scavenging performance which is improved on account of heating. Heat insulations of this type can nowadays be produced or attached, on the one hand, cost-effectively and, on the other hand, favorably in terms of weight, so that, even in the case of relatively long connecting lines between the filter device and the heat exchanger, the scavenging action improved by the heated scavenging air is preserved. Nevertheless, the filter device and the heat exchanger are, of course, preferably arranged closely adjacently to one another, so that transmission losses can be reduced as far as possible.

Other features which are considered as characteristic for the invention are set forth in the appended claims.

Although the invention is illustrated and described herein as embodied in a fuel vapor accumulator/recovery system, it is nevertheless not intended to be limited to the details shown, since various modifications and structural changes may be made therein without departing from the spirit of the invention and within the scope and range of equivalents of the claims. Those skilled in the art will readily appreciate that the features mentioned above and those yet to be explained below can be used not only in the combination specified in each case, but also in other combinations or alone, without departing from the scope of the present invention.

The construction and method of operation of the invention, however, together with additional objects and advantages thereof will be best understood from the following description of specific embodiments when read in connection with the accompanying drawing.

BRIEF DESCRIPTION OF THE DRAWING

The sole FIGURE of the drawing is a shows one possible embodiment of a fuel vapor accumulator/recovery system according to the invention.

DETAILED DESCRIPTION OF THE INVENTION

Referring now to the FIGURE of the drawing in detail there is shown a fuel vapor storage (i.e., accumulator) and recovery system 1 according to the invention, for an internal combustion engine. The internal combustion engine in this context drives a motor vehicle, which is indicated with the broken-line box 7. The assembly includes a fuel tank 2 and a filter device 4 arranged in a tank venting line 3. In this case, according to the invention, a heat transfer device or heat exchanger 5 is arranged in the tank venting line 3 and is designed in such a way that it cools the fuel vapors flowing from the fuel tank 2 to the filter device 4 and heats the ambient air aspirated in for scavenging the filter device 4. To this end, an intake line 6 is likewise routed through the heat exchanger 5. The filter device 4 may, for example, have regeneratable filter material, such as activated charcoal, which, in particular, is designed for the binding of hydrocarbons.

By way of the heat exchanger 5 arranged according to the invention, in particular, two positive effects can be implemented. On the one hand, the fuel vapors rising out of the fuel tank 2 are cooled in the heat exchanger 5, preferably to an extent such that these are even liquefied there and consequently do not reach even as far as the filter device 4 and therefore cannot subject the latter to any load. Thus, during a cooling of the fuel tank 2, for example after the stopping of the motor vehicle for a lengthy period of time, the fuel vapor liquefied in the heat exchanger 5 is returned to the fuel tank 2. On the other hand, the ambient air sucked in for scavenging the filter device 4 is heated in the heat exchanger 5, with the result that an improved scavenging performance can be achieved, with the air quantity otherwise remaining the same.

If, furthermore, the heat exchanger 5 is arranged above the fuel tank 2, as illustrated in the drawing, this makes it possible that liquefied fuel vapor can flow back into the fuel tank 2 solely due to gravity. A liquefaction of the fuel vapor is, of course, achieved only in so far as the heat exchanger 5 can cool the fuel vapors rising from the fuel tank 2 to the filter device 4 to an extent such that these are liquefied. Since the scavenging action of the scavenging air sucked in via the intake line 6 depends greatly on the temperature of said scavenging air, hot scavenging air having an improved backwash action, the backwash action can also be markedly improved by means of the heat exchanger 5 according to the invention, and therefore, together with the liquefaction of the fuel vapors rising from the fuel tank 2, which has already taken place in the heat exchanger 5, the filter device 4 can be designed to be smaller overall. The scavenging air for the backwash of the filter device 4 is in this case heated to a temperature optimal for the scavenging action.

So that the temperature of the heated scavenging air can be maintained between the heat exchanger 5 and the filter device 4, there may be provision for at least the line 6 which leads from the heat exchanger 5 to the filter device 4 or this part region to be designed so as to be heat-insulated. A heat-insulation sleeve 8 is diagrammatically indicated in the drawing FIGURE. In this case, of course, care must be taken to ensure that the spatial distance between the filter device 4, on the one hand, and the heat exchanger 5, on the other hand, is not too great, according to a particularly preferred embodiment these being combined in one common structural unit, so that heat transmission losses between the heat exchanger 5 and the filter device 4 can be minimized. The ambient air sucked in during the backwashing of the filter device 4 can subsequently be supplied to the internal combustion engine for combustion.

In general, by way of the fuel vapor storage and recovery system 1 according to the invention, on the one hand, an improved recovery of the fuel vapors rising out of the fuel tank 2 and, on the other hand, an improved backwash action on account of the backwash air heated in the heat exchanger 5 can be achieved.

The invention claimed is:

1. A fuel vapor storage and recovery system of an internal combustion engine, comprising:

a fuel tank, a tank venting line communicating with said fuel tank and conducting fuel vapors from said fuel tank, and a filter device disposed in said tank venting line;

a heat exchanger disposed in said tank venting line, configured to cool the fuel vapors flowing from said fuel tank to said filter device and to heat ambient air aspirated in for scavenging said filter device, said heat exchanger cooling the fuel vapors flowing from said fuel tank to said filter device to liquefaction, said heat exchanger optimized to heat the ambient air to a temperature that is optimal for a scavenging process, said heat exchanger disposed separately from said filter device; and an air intake line for receiving the ambient air being guided through said heat exchanger.

2. The fuel vapor storage and recovery system according to claim 1, wherein said filter device comprises activated charcoal.

3. The fuel vapor storage and recovery system according to claim 1, wherein said heat exchanger is disposed above said fuel tank, and wherein liquefied fuel vapor can flow back into said fuel tank due to gravity.

4. The fuel vapor storage and recovery system according to claim 1, wherein at least one line leading from said heat exchanger to said filter device is a heat-insulated line.

5. The fuel vapor storage and recovery system according to claim 1, wherein a connecting line between said fuel tank and said heat exchanger is disposed in said heat exchanger such that said heat exchanger is actively emptied due to a vacuum in said fuel tank, even when said heat exchanger is not arranged above the fuel tank.

6. A motor vehicle, comprising a fuel vapor storage and recovery system according to claim 1.

* * * * *